United States Patent [19]

Wojcieson et al.

[11] 4,443,182

[45] Apr. 17, 1984

[54] BURNER AND METHOD

[75] Inventors: Raymond J. Wojcieson, Annville; Leonard G. Nowak, Palmyra, both of Pa.

[73] Assignee: Hauck Manufacturing Company, Lebanon, Pa.

[21] Appl. No.: 320,007

[22] Filed: Nov. 10, 1981

[51] Int. Cl.[3] ..... F23M 9/00

[52] U.S. Cl. ..... 431/183; 431/181; 431/187; 239/406

[58] Field of Search ..... 431/173, 175, 183, 182, 431/185, 187, 188, 284; 239/405, 406

[56] References Cited

U.S. PATENT DOCUMENTS

| | | | |
|---|---|---|---|
| 1,791,011 | 2/1931 | Paulsen . | |
| 2,269,333 | 1/1942 | Bloom . | |
| 2,360,548 | 10/1944 | Conway . | |
| 3,118,489 | 1/1964 | Anthes . | |
| 3,147,795 | 9/1964 | Livingston et al. . | |
| 3,180,395 | 4/1965 | Reed . | |
| 3,227,202 | 1/1966 | Morgan . | |
| 3,576,384 | 4/1971 | Peczeli et al. | 431/182 X |
| 3,608,822 | 9/1971 | Berthoud . | |
| 3,663,153 | 5/1972 | Bagge et al. . | |
| 3,672,812 | 6/1972 | Bendixen | 431/183 X |
| 3,676,048 | 7/1972 | Sellors, Jr. et al. . | |
| 3,700,376 | 10/1972 | Niepenberg et al. | 431/188 X |
| 3,775,039 | 11/1973 | Pillard . | |
| 3,782,884 | 1/1974 | Shumaker . | |
| 4,201,538 | 5/1980 | Kopp | 239/406 X |
| 4,225,305 | 9/1980 | Hazard et al. . | |
| 4,230,445 | 10/1980 | Janssen | 431/183 X |
| 4,230,449 | 10/1980 | Binasik et al. . | |
| 4,348,170 | 9/1982 | Vatsky et al. | 431/188 |

FOREIGN PATENT DOCUMENTS

| | | | |
|---|---|---|---|
| 2202913 | 8/1972 | Fed. Rep. of Germany . | |
| 2724532 | 12/1978 | Fed. Rep. of Germany | 431/183 |
| 1284807 | 8/1972 | United Kingdom . | |
| 1530260 | 10/1978 | United Kingdom . | |

OTHER PUBLICATIONS

Hughes et al., Theory and Problems of Fluid Dynamics (1967), pp. 120–127.

Marino et al., U.S. patent application for "Aggregate Dryner Burner and Method", Ser. No. 157,434, filed Jun. 9, 1980.

Wojcieson et al., U.S. patent application for "Burner and Method", Ser. No. 256,851, filed Apr. 23, 1981.

*Primary Examiner*—Samuel Scott
*Assistant Examiner*—Randall L. Green
*Attorney, Agent, or Firm*—Finnegan, Henderson, Farabow, Garrett & Dunner

[57] ABSTRACT

An industrial burner having an axial recirculation flame with active vortex mixing in the combustion chamber and method.

19 Claims, 5 Drawing Figures

BURNER AND METHOD

The invention relates to an improved industrial heating burner and method. The burner is of the type used to fire industrial furnaces for a number of applications, including melting aluminum, heat-treating and normalizing metal parts, and firing ceramics and glassware. The burner efficiently burns gas or No. 2 through No. 6 fuel oils or combinations of oil and gas.

Violent intermixing of the fuel and gases in the burner combustion chamber is achieved by generating seed vortexes at a number of locations spaced around the combustion chamber, amplifying the seed vortexes and flowing the enlarged vortexes through the chamber as part of a recirculation flow. The vortexes are formed by flowing primary air and fuel and secondary air at an angle across the downstream edge of a cone separating the flows so that the flows shear against each other. The vortexes are amplified by the shearing flows as they over downstream from the edge for active intermixing of the flows. The vortexes are stabilized by high-pressure secondary air flows spaced around the circumference of the burner.

The active intermixing of the constituents within the combustion chamber forms a very intense and efficient flame. The flame has a high exit velocity which is relatively uniform across the mouth of the burner. The flame improves gas mixing within the heating furnace chamber, drives hot gases deep within the chamber and improves convective heating.

Conventional industrial heating burners swirl the primary and secondary air in order to throw it radially outwardly within the combustion chamber, reduce the axial pressure in the chamber and establish a toroidal recirculation zone for carrying gases axially upstream to the burner head and forming a stable flame. The fuel also may be swirled. Swirl is imparted to the combustion air by radial or axial swirl generators placed in the primary and secondary air flow paths upstream of the burner head. An example of this type of heating burner is described in Marino et al copending U.S. patent application, Ser. No. 157,434, filed June 9, 1980. The present burner provides improved mixing and combustion without the necessity of swirling the fuel, primary or secondary air.

Other objects and features of the invention will become apparent as the description will become apparent as the description proceeds, especially when taken in conjunction with the accompanying drawings illustrating the invention, of which there are two sheets and one embodiment.

IN THE DRAWINGS

DESCRIPTION OF THE BURNER

Figure 1:
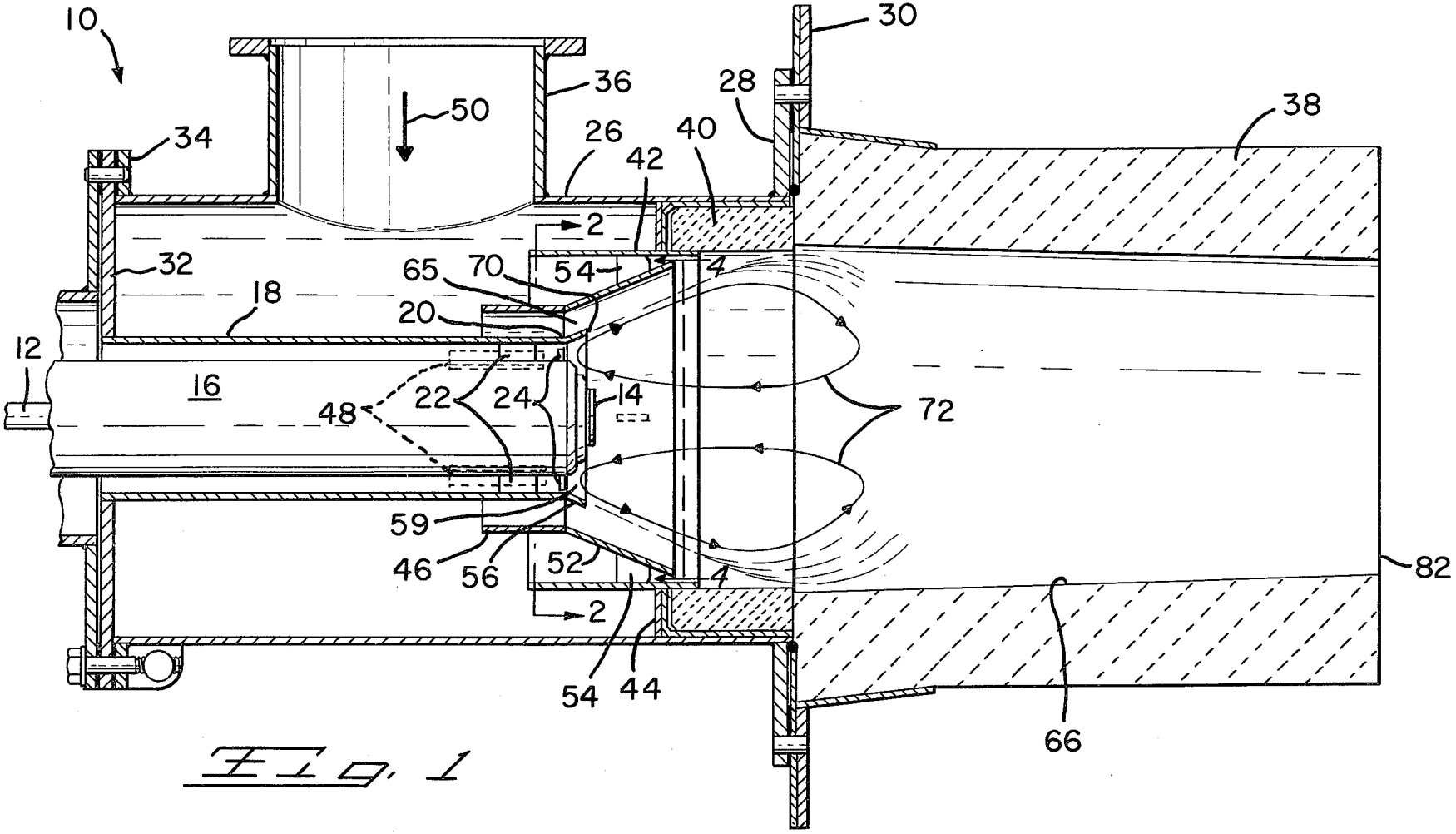
FIG. 1 is a longitudinal, cross-sectional view, partially broken away, illustrating a burner according to the invention.

Burner 10 includes an axial fuel oil pipe 12 extending downstream from a fuel oil source (not illustrated) to an atomizer 14 located at the burner head. A primary air pipe 16 surrounds the pipe 12 and atomizer 14 and extends from a source of primary air (not illustrated) downstream to an end at atomizer 14. Gas pipe 18 surrounds the primary air pipe and extends from a gas source (not illustrated) downstream to an end 20 at the atomizer. Spacers 22 locate the primary air pipe 16 within gas pipe 18. Gas baffles 24 are provided at the downstream end of the gas passage between pipes 16 and 18 to accelerate the gas exit velocity.

Large diameter secondary air pipe 26 surrounds the pipes 12, 16 and 18 and is provided with a mounting ring 28 at its downstream end. The burner is secured in place on the furnace by mounting ring 28 on furnace plate 30 as shown. The upstream end of gas pipe 18 is secured to an end plate 32 which in turn is removably fixed to mounting ring 34 on the upstream end of the primary air pipe. Secondary air inlet pipe 36 is mounted on one side of pipe 26 such that secondary air flows radially into the pipe.

Furnace plate 30 supports a main combustion tile 38 extending downstream from the burner and formed from suitable refractory material. An inner refractory ring 40 is provided at the upstream end of tile 38 within the end of the secondary air pipe. Fixed burner head alignment collar 42 is secured to the downstream end of pipe 26 by a spacer ring 44. Collar 42 is coaxial with pipe 12, 16 and 18.

Figure 2:
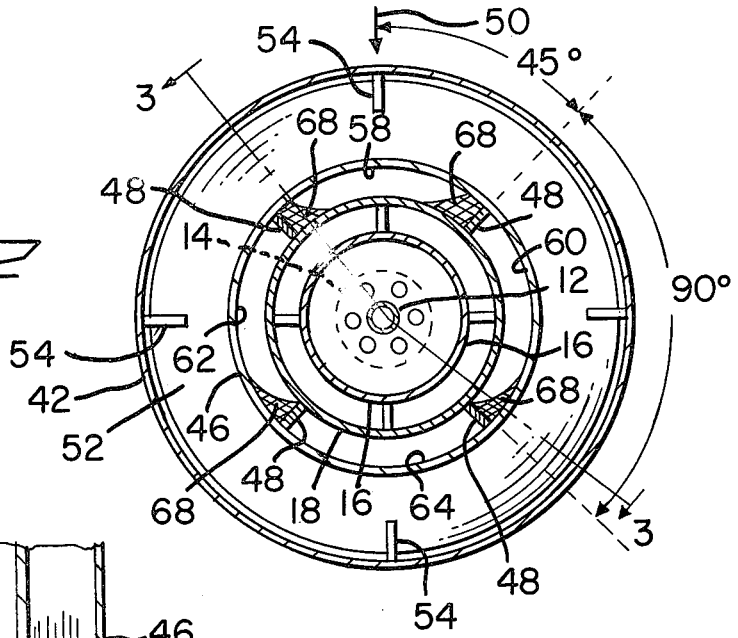
FIG. 2 is a cross-sectional view taken along line 2—2 of FIG. 1.
Figure 4:
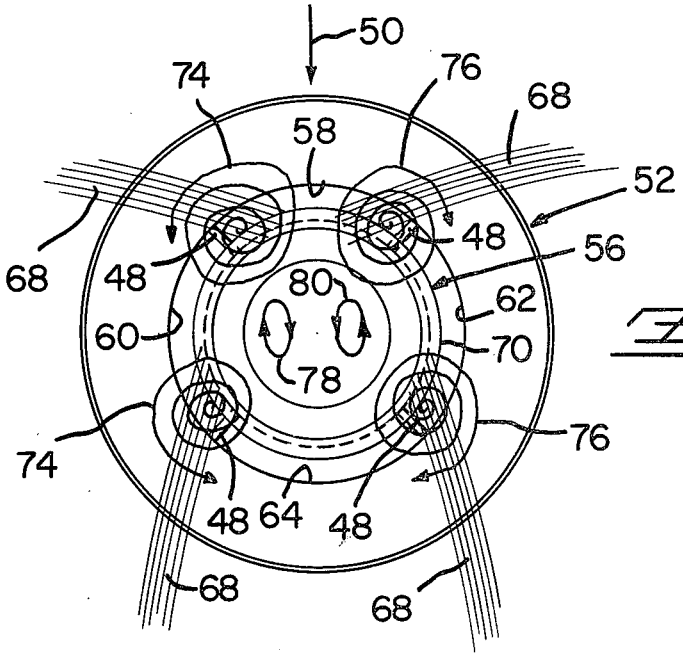
FIG. 4 is a cross-sectional view taken along 4—4 of FIG. 1 illustrating the vortexes.

Collar 46, coaxial with pipes 12, 16 and 18, extends around the downstream end of the gas pipe 18 and is secured to the gas pipe by four support vanes 48. As illustrated in FIG. 1, vanes 48 extend upstream an appreciable distance beyond the upstream end of collar 46 into the radial inward flow of secondary air through inlet pipe 36. The downstream ends of vanes 48 are spaced upstream from the downstream end of collar 46. In FIGS. 1, 2 and 4 arrow 50 represents the direction of flow of secondary air through pipe 36 into the secondary air pipe 26. Arrow 50 is on the longitudinal axis of inlet pipe 36. As illustrated in FIG. 2, the vanes 48, which also function as spacers, are located at angles of 45° and 135° to either side of the axis of pipe 36. The spaced vanes 48 divide the secondry air flow passage between the gas pipe 18 and collar 46 into four equal area secondary flow passages 58, 60, 62 and 64.

Outer frustroconical cone 52 is attached to the downstream end of collar 46 and extends downstream and radially outwardly from the collar to an end closely adjacent collar 42. The cone is aligned in the collar by spacers 54. A short inner frustroconical cone 56 is attached to the downstream end 20 of the gas pipe 18. The cones 52 and 56 diverge outwardly of the longitudinal axis of the burner at an angle of 22 ½ degrees. This angle of divergence is effective in generating vortexes at the edge of cone 56, in a manner to be described.

OPERATION OF BURNER

Burner 10 may be fired using grades 2 through 6 fuel oil, gas or a combination of oil and gas. The fuel is delivered to an annular space 59 between the atomizer 14 and cone 56 in the following manner. Gas and primary air are delivered directly to this space from, respectively, gas pipe 18 and atomizer 14. A flow of atomized oil and primary air is delivered to the area radially from atomizer 14. The resulting fuel mixture flows downstream along the inner surface of cone 56 and into the combustion chamber. Constant pressure primary air is supplied to burner 10 at all burn levels. The primary air pressure may vary from 16 to 24 ounces per square inch, depending upon the grade of oil being burned. The higher pressure is required to atomize heavy No. 6 oil. The secondary air may have a pressure of about 7 ounces per square inch. The secondary air flow and rate of fuel delivered to the burner are increased with increasing burn rates.

During operation of the burner, secondary air is flowed through pipe 36 into the secondary air pipe 26, through the four passages 58, 60, 62 and 64, through the annular passage 65 between the cones 52 and 56 and into the upstream end of the combustion chamber 66 in cone 52. Some of the secondary air flows into the combustion chamber through the gap between the end of the cone 52 and alignment collar 42. This narrow flow does not adversely affect operation of the burner. The gap between the cone and collar results because of manufacturing tolerances.

As described earlier, secondary air flows radially into pipe 26 in the direction of arrow 50. Vanes 48 extend upstream beyond collar 46 into the radial inward flow of secondary air moving in direction 50 and guide the air into passages 58, 60 and 62. The radial inward momentum of the air in the direction of arrow 50 forms relatively high pressure secondary air flows 68 in passages 58, 60 and 62 on the sides of the vanes 48 facing the secondary air inlet pipe. Flows 68, as shown in FIG. 2 adjacent vanes 48, are at relatively higher pressure than the remaining secondary air flow through each passage 58, 60 and 62. There are two high pressure secondary air flows, represented by numeral 68 in passage 58, one high pressure secondary air flow 68 in passages 60 and 62, and no such high pressure flow in passage 64. Secondary air also flows into the space 65 through the remaining cross-sectional areas of passages 58, 60 and 62 and passage 64, but this particular flow is at a lower pressure.

The high-pressure secondary air flows 68 continue downstream beyond vanes 48, through space 65 (between cones 52 and 56) and into the combustion chamber. The relatively lower pressure secondary air, between the flows 68, also flows between the cones and into the combustion chamber. The cross sectional area of the secondary air flow path at space 65 between the cones is less than the cross sectional area between pipe 18 and collar 46 so as to accelerate the secondary air as it enters combustion chamber 66. The inner cone 56 deflects the secondary air stream outwardly toward the outer cone 52.

Secondary air flowing through passages 58, 60, 62 and 64 and beyond cone 56 retains some radial momentum in the direction of arrow 50 so that the high pressure flows 68 are discharged across the downstream edge 70 of the inner cone 56 with a component of momentum in the direction of arrow 50. This momentum deflects the high pressure flows away from the inlet pipe side of the burner so that they all shear past the edge 70 of the cone at an acute angle. See FIG. 4. The flows 68 angle across edge 70 in opposite directions on opposite sides of the inlet pipe 36 so that the resulting pattern of flow is symmetrical about a plane defined by the axis of the burner and the axis of the inlet pipe 36. The secondary air is not swirled into the combustion chamber.

During low burn operation of the burner, primary air and fuel are flowed along the inner side of cone 56 and downstream and outwardly across cone edge 70. This flow expands radially outwardly as it flows into the combustion chamber and does not shear across the edge 70 at an angle. At low burns, the air-fuel mixture is entrained with secondary air flowing through passages 58, 60, 62 and 64 and flows into the combustion chamber. The low-burn flame is relatively long and narrow and tends to wander within the combustion chamber 66.

With increased fuel and secondary air flow, the velocity of the air flowing through passages 58, 60, 62 and 64 increases, a low pressure zone 72' is formed adjacent cone 52 immediately downstream of the end of collar 46 and the Coanda effect draws the secondary air flow against the surface of cone 52. This flow strikes the adjacent wall of the combustion chamber and is reflected back into the chamber as shown in FIG. 1. The increase in primary air velocity and the outward flow resulting from the Coanda effect reduce the axial pressure of the combustion chamber downstream of the atomizer 14 so that gases and unburned fuel products are drawn axially upstream, mix with the fuel and primary air in space 59, flow along the inner surface of cone 56 and are again recirculated downstream with the secondary air flow. This type of toroidal internal recirculation is illustrated diagrammatically by flow lines 72 in FIG. 1.

The fuel, primary air and recirculation gases flow down the inner surface of cone 56, across cone edge 70 and expand radially outwardly as they flow into the chamber 66. The high pressure secondary air flows 68 shear across the outer surface of cone 56 and edge 70 at an angle with respect to that part of the flow of fuel, primary air and recirculation gases in their flow paths. This angular mixing of the flows 68 and the flow on the inside of cone 56 at edge 70 generates a continuously large number of small seed or edge vortexes. These seed vortexes are believed to be similar to the vortexes formed on the trailing edges of airplane wings. While a greater density of these vortexes is believed to be formed on the edges 70 adjacent the high-density flows 68, vortexes may be formed around the entire circumference of the edge 70 and some seed vortexes may be formed on the downstream edges of vanes 48. Seed vortexes form more readily where the shearing streams have a higher pressure differential. Tests indicate the pressure differential across cone 56 at the high-velocity flows 68 are greater than the pressure differential across vanes 48 above their downstream edge or across the cone 56 away from the flows 68.

Figure 3:
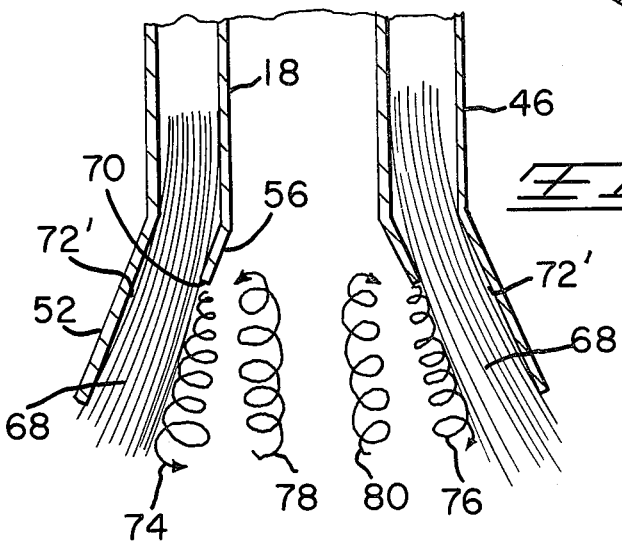
FIG. 3 is a generalized cross-sectional view taken across the head of the burner at line 3—3 of FIG. 2 illustrating the mixing vortexes.

The seed vortexes formed on edge 70 are rapidly amplified to form large, downstream expanding vortexes 74 and 76 illustrated in FIGS. 3 and 4. Because of the shearing action of flows 68 across the flow from the inside of cone 56, vortexes 74 on the lefthand side of the axis of inlet pipe 36 swirl counterclockwise as viewed in an upstream direction and vortexes 76 swirl clockwise. The vortexes 74 and 76 are stabilized by the high pressure flows 68 and do not tend to wander around the edge 70, despite the relatively lower pressure of the secondary air to either side of the flows 68. This stability is believed the result of the higher linear momentum of the flows 68 which overcomes the tendency of swirls to migrate to lower pressure areas. The stability of the vortexes stabilizes the flame within the combustion chamber.

The rapidly swirling and mixing flows of primary air, fuel, secondary air and hot combustion products are reflected off the surrounding wall of the chamber 66 back into the chamber as shown in FIG. 1. The reflected gas mixture is believed to retain a slight angular momentum in the direction of vortexes 74 and 76 so that the flow of gases drawn upstream along the recirculation paths generally indicated at 72 in FIG. 1 is imparted with angular momentum in the opposite rotational direction as viewed looking upstream from that of the downstream extending vortexes 74 and 76. The outer peripheries of the downstream extending vortexes 74, 76 may shear or flow past the outer peripheries of the upstream extending inner flow to impart momentum to these flows and reinforce them. Upstream moving vortex 78 rotates in the opposite direction to adjacent downstream vortexes 74 so that their adjacent edges move in the same direction. Vortex 80 rotates in the opposite direction to adjacent downstream vortexes 76 so that their adjacent edges move in the same direction. At the upstream end of the recirculation zone adjacent cone 56, the axial upstream-moving vortexes flow downstream along the inner surface of the cone and the recirculation cycle is repeated.

In the drawings, the vortexes are illustrated generally. The exact shape and location of upstream-extending vortexes is not known. The vortexes are formed, amplified and decay rapidly. The large number of continuously formed seed vortexes assures that amplified vortexes continuously flow into the combustion chamber and violently intermix the gases and unburned fuel in the chamber. The recirculation lines 72 of FIG. 1 represent the median or mass flow of recirculation gases and do not accurately represent the actual flow of gases and fuel particles as they are swirled, mixed, heated and burned.

Large mixing vortexes are formed when the secondary air increases to a given velocity, called the critical velocity. When the secondary air flowing past edge 70 is at a velocity below the critical velocity, the burner flame is relatively long and unstable. When the critical velocity is attained, vortexes extend downstream from edge 70, mixing is improved, combustion intensity improves and the flame is immediately shortened and stabilized. The eddies violently intermix the primary air, fuel, secondary air and combustion products to form an intense central flame.

Figure 5:
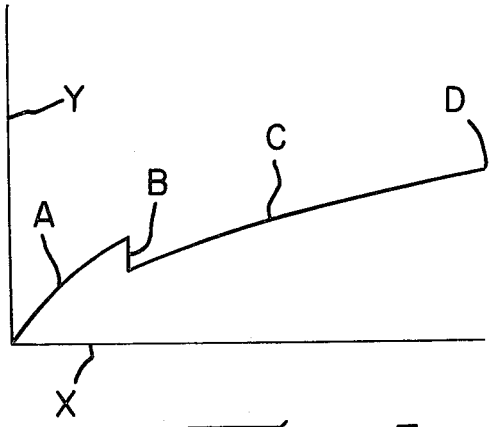
FIG. 5 is a graph having a vertical axis indicating flame length and a horizontal axis indicating rate of fire for the disclosed burner.

FIG. 5 is a graph having a horizontal axis X indicating the rate of burn for burner 10 and a vertical axis Y indicating the length of the flame downstream from the burner. During portion A of the curve, the fuel and secondary air supplied to the burner are increased from low burn to increase the burn rate and the flame length increases correspondingly. At portion B of the curve, the velocity of the secondary air has increased sufficiently to generate vortex recirculation and mixing and the length of the flame is immediately reduced as mixing is improved. During portion C of the curve, the length of the flame increases relatively gradually in comparison to portion A as secondary air and the fuel are increased to bring the flame to the high-burn point D.

The improved combustion efficiency is achieved without expending energy to swirl the fuel or primary or secondary air flows into the combustion chamber. As a result, the energy required to operate the burner is reduced over similar sized conventional swirl-type burners.

The violent vortex mixing in the combustion chamber results in uniform and complete combustion and produces a high-velocity through burner mouth 82. For example, in a burner as illustrated having an alignment collar 42 with an interior diameter of $10\frac{1}{2}$ inches, the high-burn discharge velocity at mouth 82 may be as much as 17,500 feet per minute. The exit velocity is more uniform across the mouth 82 than in conventional swirl-type burners. The high exit velocity improves mixing within the furnace chamber, drives the hot gases deep into the chamber and improves convective heating within the furnace.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim our invention is:

1. In an industrial burner having means for delivering fuel into a combustion chamber having a wall, a system for intermixing air, fuel and recirculating gases within the combustion chamber to provide a flame having substantially uniform combustion gas profiles of velocity and temperature at the combustion chamber exit, the system comprising:

a secondary air passage for the flow of secondary air surrounding the fuel delivering means and having an inner wall, an outer wall and means for dividing said secondary air passage into a plurality of separate flow passages to provide zones of relatively higher pressure secondary air flow forming along said dividing means adjacent relatively lower pressure secondary air flow within at least one of said flow passages;

a flow attachment wall connected to the outer wall of said secondary air passage and extending divergingly into the combustion chamber away from the axial centerline of said combustion chamber;

a secondary air chamber surrounding said secondary air passage at the entrance to said passage for providing secondary air to said secondary air passage in a direction non-parallel to the longitudinal axis of said secondary air passage and each said secondary air passage dividing means;

a secondary air inlet means for supplying secondary air to said secondary air chamber;

said secondary air chamber being connected between said inlet means and said secondary air passage;

deflector means connected to the end of said secondary air passage inner wall downstream of said dividing means for promoting attachment of said secondary air flow along said flow attachment wall and for providing a boundary between regions of different pressures adjacent said deflector means in the combustion chamber to promote generation of vortexes by the interaction of the zones of high-pressure secondary air flow with the fuel and recirculating gases.

2. A system as in claim 1, wherein said means for dividing said secondary air passage comprises a plurality of vanes, each vane having a first and second vane edge attached respectively to said inner wall and said outer wall, a third vane edge extending upstream of said secondary air passage and a fourth vane edge terminating prior to said deflector means.

3. A system as in claim 1, wherein said deflector means comprises a truncated conical member connected at the smaller radius end to the inner wall of said secondary air passage and having the larger radius end extending toward said flow attachment wall.

4. A system as in claim 2, wherein said deflector means comprises a truncated conical member connected at the smaller radius end to the inner wall of said secondary air passage and having the larger radius end extending toward said flow attachment wall.

5. A system as in claim 1, wherein said flow attachment wall comprises a truncated conical member connected at the smaller rdius end to the outer wall of said secondary air passage and having the larger radius end terminating at the combustion chamber wall.

6. A system as in claim 2, wherein said flow attachment wall comprises a truncated conical member connected at the smaller radius end to the outer wall of said secondary air passage and having the larger radius end terminating at the combustion chamber wall.

7. A system as in claim 3, wherein said flow attachment wall comprises a truncated conical member connected at the smaller radius end to the outer wall of said secondary air passage and having the larger radius end terminating at the combustion chamber wall.

8. A system as in claim 1, wherein said deflector means and said flow attachment wall are truncated conical members, substantially concentrically disposed relative to one another.

9. A system as in claim 2, wherein said deflector means and said flow attachment wall are truncated conical members, substantially concentrically disposed relative to one another.

10. A system as in claim 1, wherein the inner and outer walls of said secondary air passage comprise two concentric cylinders forming an annulus.

11. A system as in claim 2, wherein the inner and outer walls of said secondary air passage comprise two concentric cylinders forming an annulus.

12. A system as in claim 3, wherein the inner and outer walls of said secondary air passage comprise two concentric cylinders forming an annulus.

13. A system as in claim 4, wherein the inner and outer walls of said secondary air passage comprise two concentric cylinders forming an annulus.

14. A system as in claim 5, wherein the inner and outer walls of said secondary air passage comprise two concentric cylinders forming an annulus.

15. A system as in claim 6, wherein the inner and outer walls of said secondary air passage comprise two concentric cylinders forming an annulus.

16. A system as in claim 7, wherein the inner and outer walls of said secondary air passge comprise two concentric cylinders forming an annulus.

17. A system as in claim 8, wherein the inner and outer walls of said secondary air passge comprise two concentric cylinders forming an annulus.

18. A system as in claim 9, wherein the inner and outer walls of said secondary air passage comprise two concentric cylinders forming an annulus.

19. A system as in claim 2, wherein said vanes are four in number and are spaced apart within said secondary air passage at equal distances.

* * * * *